United States Patent [19]

Chesnut

[11] 4,154,173

[45] May 15, 1979

[54] ARTIST'S TABLE-EASEL

[76] Inventor: Charles R. Chesnut, 1819 E. Lamona, Fresno, Calif. 93703

[21] Appl. No.: 763,240

[22] Filed: Jan. 28, 1977

[51] Int. Cl.[2] ..... A47B 27/14

[52] U.S. Cl. ..... 108/6; 248/451

[58] Field of Search ..... 108/6, 90, 65, 10; 248/448, 425, 451, 452, 453

[56] References Cited

U.S. PATENT DOCUMENTS

| | | | |
|---|---|---|---|
| 236,845 | 1/1881 | Scheurich | 248/452X |
| 543,492 | 7/1895 | Laughlin et al. | 108/6 X |
| 1,373,473 | 4/1921 | Weydell | 108/6 |
| 1,376,272 | 4/1921 | Handley | 248/451 |
| 1,529,022 | 3/1925 | Fraser | 108/6 |
| 1,575,897 | 3/1926 | Cole | 108/65 X |
| 3,641,946 | 2/1972 | Charnay | 108/6 |
| 3,813,075 | 5/1974 | Capper | 248/451 |

*Primary Examiner*—Francis K. Zugel
*Attorney, Agent, or Firm*—Huebner & Worrel

[57] ABSTRACT

Disclosed is a table-easel which supports a working surface in such a manner that it is readily movable in three directions, height, tilt, and rotation. The height adjustment is achieved by means of a pair of telescopically assembled uprights on a base and support frame which are raised and lowered by a double action turnscrew. The working surface is provided by a tabletop mounted on a cross shaft rotatably supported between the upper ends of the support frame, and tilt is achieved by rotating the cross shaft about its substantially horizontal axis. A locking structure is provided at one end of the cross shaft to lock the shaft in a particular tilt position. To permit rotation of the tabletop about a central axis normal to its surface, a pair of trunnion plates are provided. The tabletop is attached to one of the plates, and the other is attached to the cross shaft. The plates are normally movable with respect to each other but can be readily locked in a particular position so that the rotational position of the tabletop can be fixed. Adjustable clamps are provided to secure paintings or panels of different sizes and configurations on the tabletop even when it is near vertical position.

3 Claims, 11 Drawing Figures

Fig. 2
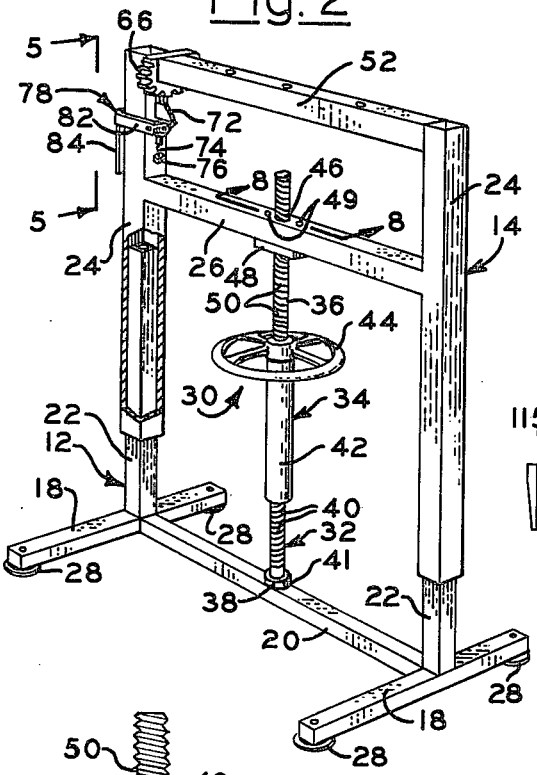
Fig. 3
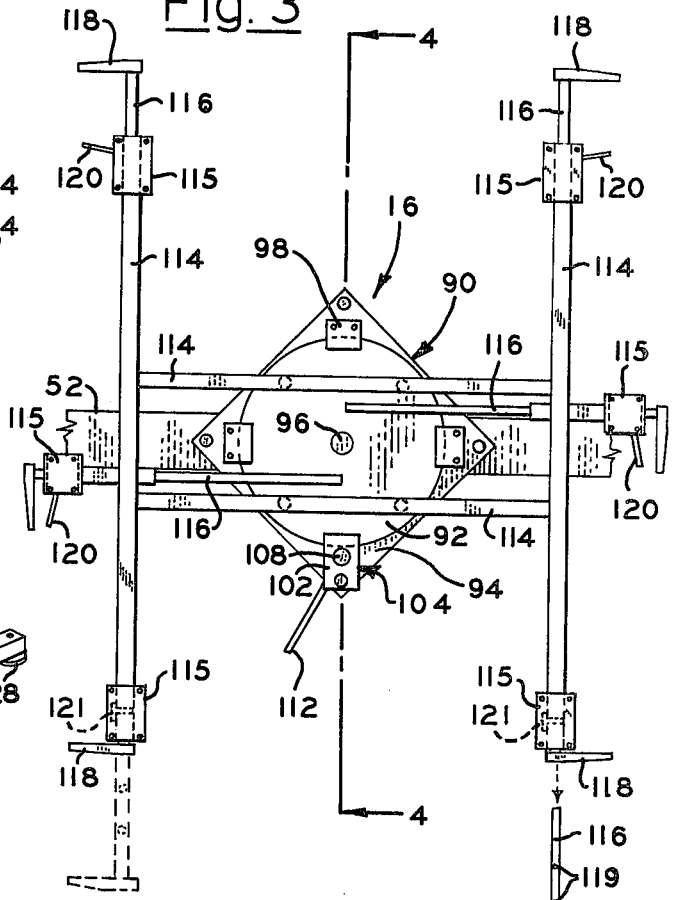
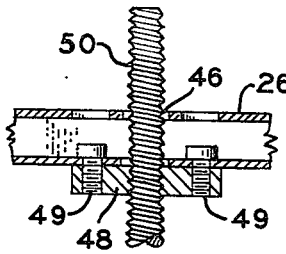
Fig. 8
Fig. 4
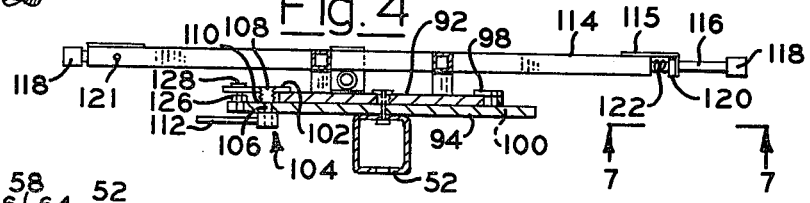
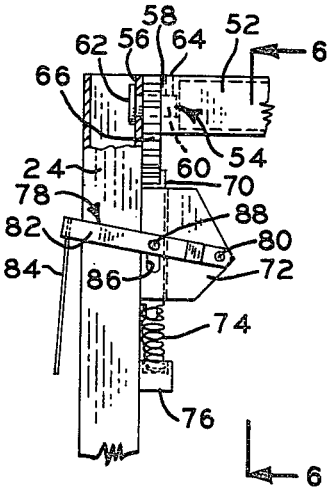
Fig. 5
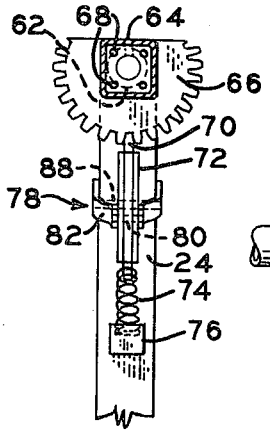
Fig. 6
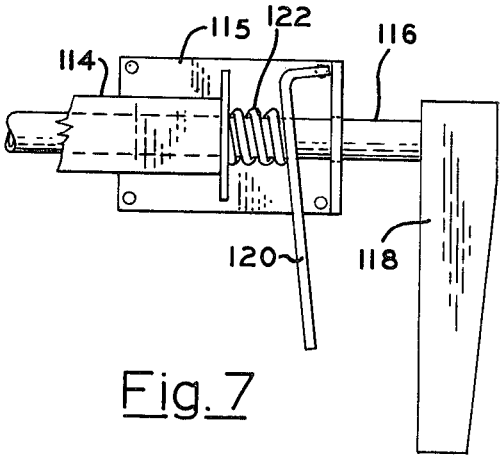
Fig. 7

ARTIST'S TABLE-EASEL

BACKGROUND OF INVENTION

My invention relates generally to work tables and easels or more particularly to relatively stationery artist's tables and easels with adjustment means for disposing the working surface in convenient working positions. The modern artist frequently works on projects that require both a drafting table and an easel. The typical drafting table is adjustable, if at all only with respect to tilt of the table surface. That is, the table can be elevated on the side opposite the working edge to tilt the working surface toward the draftsman. Artist's easels of commonly known types place the working surface near vertical with the upper edge tilted slightly from the artist. Tilt adjustment of the easel can be achieved by spreading or gathering the support legs, and various other methods.

More recently tables have been conceived for the use of draftsmen or artists that are adjustable in height as well as is tilt. The artists need to rotate his working surface about a central perpendicular axis has also been recognized but attempts to provide a table with this feature, in combination with the others, have not been truly successful.

Heretofore no table has been created which effectively combines into a single, relatively simple unit the full adjustability and versatility which meet the needs of both the artist and the draftsman.

It is therefore, a major object of my invention to provide a table-easel which provides ready adjustability of the work surface in height, tilt, and rotation about a perpendicular axis.

It is also an important object of my invention to provide a combined art easel and drafting table which, while providing the aforementioned versatility of adjustment, is yet compact, relatively lightweight and easily movable.

It is another object of my invention to provide a table-easel of the type described in which the elevating mechanism is a double acting turnscrew so that a substantial change in elevation is achieved on each rotation of the screw, and no locking mechanism is necessary because the turnscrew supports the table without moving, when it is released.

It is further object of my invention to provide a table-easel of the type described in which the work surface tilting mechanism includes a ratchet gear with a lock pawl which is manually releasable with one hand of the operator so the tabletop can be tilted with the other hand.

It is still another object of my invention to provide a table-easel of the type described in which the working surface is rotatable about a perpendicular central axis by a readily releasable clamp mechanism which can be operated by one hand of the operator while the other hand is utilized to rotate the tabletop.

It is still a further object of my invention to provide a table-easel of the type described in which the paintings, frames and panels of different sizes and configurations can be quickly but securely attached to the tabletop by means of the readily adjustable clamps.

It is yet another object of my invention to provide a table-easel of the type described which can be inexpensively made and yet provide a very stable working platform which is compact, lightweight, and readily movable.

These and other objects and advantages of my invention will be more readily apparent from the following detailed description of a preferred embodiment and the accompanying drawings in which:

FIG. 2 is a perspective view of the base and support frame in my preferred embodiment;

FIG. 3 is a plan view of a tabletop supporting structure of my preferred embodiment;

FIG. 4 is a sectional view taken on 4—4 in FIG. 3;

FIG. 5 is an enlarged elevational view taken at 5—5 in FIG. 2 showing the tilt shaft locking mechanism in my preferred embodiment;

FIG. 6 is an elevational view taken at 6—6 in FIG. 5;

FIG. 7 is an enlarged bottom view taken at 7—7 in FIG. 4;

FIG. 8 is a partial sectional view taken at 8—8 in FIG. 2;

DETAILED DESCRIPTION OF PARTS

Figure 1:
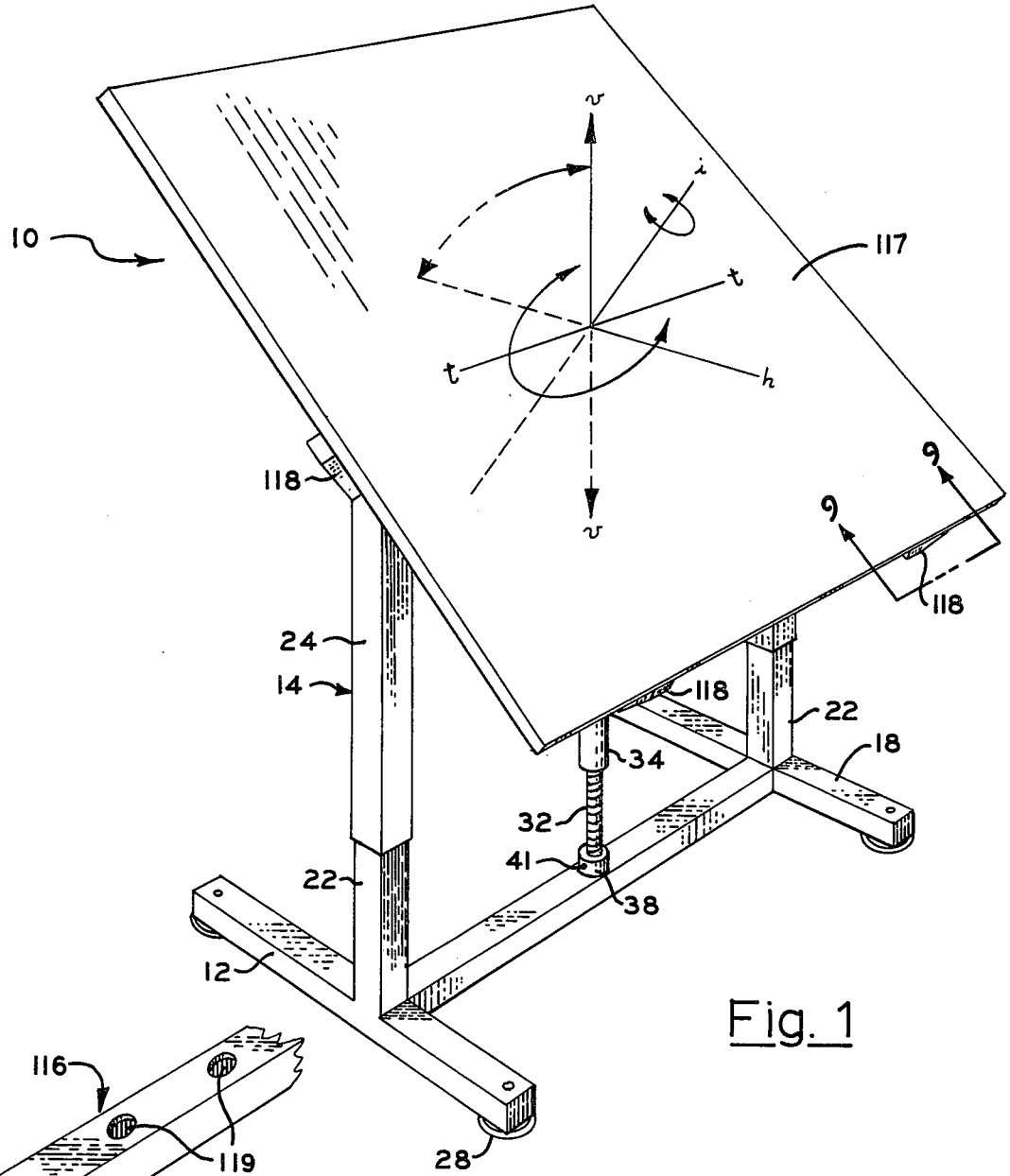
FIG. 1 is a perspective view of a preferred embodiment of my invention.
Figure 10:
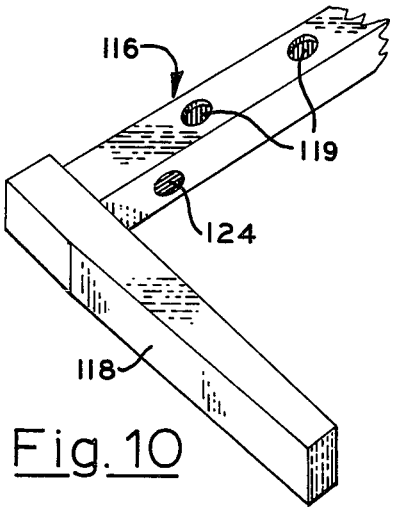
FIG. 10 is an enlarged perspective view of the bottom support clamps shown in FIG. 9.

Referring now to the drawings and particularly FIGS. 1 through 3 thereof, the numeral 10 designates generally my improved table-easel. The table-easel 10 consists of a base 12, a support frame 14, and a work mounting frame 16. The base 12 has a pair of spaced parallel feet 18 connected at their midpoints by a cross brace 20. The feet 18 and cross brace 20 rest on a support surface or floor and support a pair of upright spaced parallel stanchions 22, each of which is mounted at its lower end to the midpoint of one of the feet 18, and extends upwardly to support one side of the support frame 14.

The support frame 14 is formed of two spaced parallel support arms 24 which are connected into an H frame by a cross arm 26 that attaches to the support arms 24 at slightly above their midpoints. The support arms 24 have their lower ends telescopically assembled on the upper ends of the stanchions 22 and are movable vertically on the stanchions. Adjustable pads 28 are provided on each end of the feet 18 for stabilization.

To drive the support frame 14 vertically on the base 12, I provide an elevating mechanism 30. The elevating mechanism 30 is disposed between the cross brace 20 in the base 12 and the cross arm 26 in the support frame 14, and consists of a lower shaft 32, turn screw 34, and an upper shaft 36. The lower shaft 32 is mounted at its lower end in a receptical cap 38 secured to the middle of the cross brace 20. The lower shaft 32 has external threads 40 and is secured against rotation in the cap 38 by securing pin 41. The turnscrew 34 has a sleeve 42 with internal threads which threadably engage the upper end of the lower shaft 32, and a handle 44 for rotating the sleeve. At its upper end, the turnscrew 34 is attached to the upper shaft 36 so that the upper shaft 36 turns with the turnscrew. The upper shaft 32 passes through an opening 46 in the cross arm 26 and has threads 50 which engage with a blocknut 48 fixedly secured to the cross arm 26 by screws 49 (see FIG. 8). Therefore, as the turnscrew 42 is rotated by the handle 44, the upper shaft 36 rotates in threaded engagement with the blocknut 48 moving the cross arm 26 threadedly along the upper shaft. Rotation of the turnscrew also causes it to move along the upper end of the lower shaft 32 by reason of the threaded engagement of the sleeve 42 with the threads 40 on the lower shaft. Threads 40 are lefthand threads while threads 50 are righthand. As a result, the support frame 14 is moved with respect to the base 12 twice the distance of the thread pitches for each rotation of the turnscrew 34.

The work mounting frame 16 is supported in the upper ends of the support frame 14 by means of a tilt shaft 52 which is disposed between and rotatably mounted in the upper ends of the support arms 24. To rotatably mount the tilt shaft 52 in the upper ends of the support arms, mounting pins 54 are provided which are passed through shaft holes 56 in the upper ends of the support arms. (See FIGS. 5 and 6). The mounting pins 54 have a shank portion 60 with a shoulder 62 at one end which engages the support arm 24 about the hole when the shank portion 60 of the mounting pin is inserted through the support arm hole 56 and into the receptacle 58 in the tilt shaft 52. To hold the mounting pins 54 in the receptable 58, transverse set screws 64 are passed transversely through each end of the tilt shaft 52 and when threadedly tightened to engage the inner ends of the shank portions 60.

To lock the tilt shaft 52 in a particular position, a semicircular ratchet gear 66 is mounted on one end of the tilt shaft 52 adjacent one of the support arms 24 and secured to the tilt shaft by screws 68. A lock pawl 70 is provided in a housing 72 mounted on the support arm 24 just below the ratchet gear 66. The lock pawl 70 has a compression spring 74 with its lower end disposed in a socket 76 mounted on the support arm. The spring 74 resiliently urges the lock pawl 70 against the teeth of ratchet gear 66 to lock the pawl in the gear teeth and prevent movement of the tilt shaft 52.

A pawl lever 78 is pivotally mounted in the pawl housing 72 at pivot 80 and has a pair of spaced parallel drive legs 82 and an actuating handle 84. The drive legs 82 have slots 86 which engage a pair of cam pins 88 which extend laterally from opposite sides of the lock pawl 70 and drive the pawl downward against the spring 74 when the actuating handle 84 is forced inwardly against the support arm 24. This removes the lock pawl 70 from the teeth of the ratchet gear 66 and permits rotational movement of the tilt shaft 52 about its generally horizontal axis.

To provide mounting means for a work board or tabletop, pivot plate assembly 90 is mounted in the middle of tilt shaft 52 (see FIG. 3). The pivot plate assembly 90 includes a work engaging plate 92 and a base plate 94. The base plate 94 is secured to the tilt shaft 52 and the work engaging plate 92 is mounted on the base plate 94 in sandwiched relationship and is movable rotatably with respect thereto. A center pin 96 provides an axis in the center of the plates perpendicular to their surfaces about which the work engaging plate rotates and is secured at its lower end in the tilt shaft 52. Peripheral lugs 98 are provided at quadrant positions about the periphery of the work engaging plate 92 and are secured to the base plate 94. The lugs 98 have an upstanding portion 100 that extends upwardly from the base plate 94 adjacent the periphery of the center plate 92 and a projecting lip 102 at the upper end which extends inwardly over the periphery of the work engaging plate and thereby holds the periphery of the work engaging plate on the base plate (see FIG. 4).

A plate clamp 104 replaces one of the peripheral lugs 98 to provide means to clamp the lug down on the periphery of the work engaging plate 92 and thereby lock the work engaging plate 92 against rotation with respect to the base plate 94. As best shown in FIG. 4, the plate clamp 104 consists of a clamp shaft 106 which is journaled in the base plate and has a threaded upper end 108 that threadedly engages a tapped hole 110 in the lip 102 of the associated lug. The threads have a large pitch to provide substantial axial movement for each rotation of the clamp shaft. At the lower end of the clamp shaft 106, a clamp handle 112 is mounted that extends radially outward from the clamp shaft and is adapted to permit manual rotation of the clamp shaft to thread it in threaded hold 110 of the lip 102. As the clamp shaft 106 is rotated, the threads draw the lip 102 downward to clamp the work engaging plate 92, or move it upwardly to release the work engaging plate 92 for rotation with respect to the base plate 94. The lip 102 is anchored by a hold pin 126 in the base plate 94 which passes through an opening at the mounted end of the lip. The opening is larger than the shank of the pin 126 to permit wobbling movement of the lip, and the pin has a head 128 to hold the lip on the shank.

Figure 11:
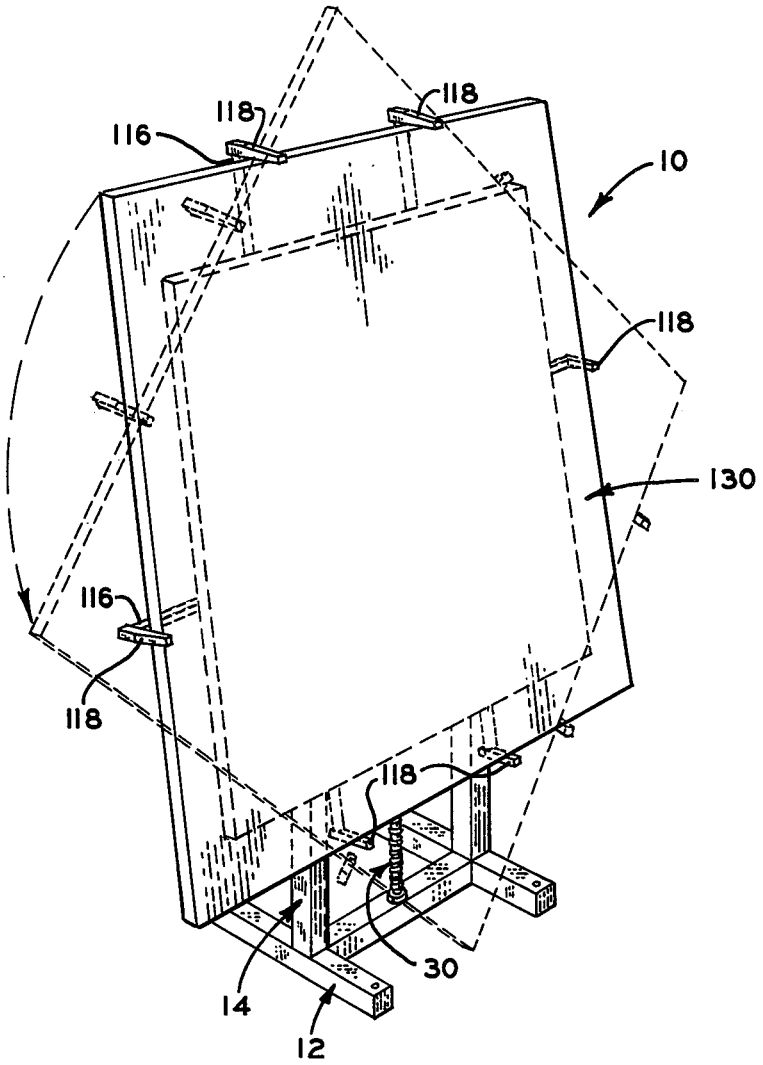
FIG. 11 is a perspective view of my preferred embodiment with a painting clamped to the tabletop showing its facility as an easel.

To secure a working surface or table top 113 to the work engaging plate 92, I provide a mounting frame 114 with six mounting arms 116 telescopically supported in the frame. The mounting frame 114 has attachment plates 115 which are screw attached to the bottom surface of a table top 117 that can serve either as a working surface and as a support surface for other working surfaces. The arms 116 are utilized to hold larger working surfaces such as larger work boards, frames or canvas on the table top 117 as best illustrated in FIG. 11. Work forms smaller than the table top 117 can be held on the table top by c-clamps or other known devices.

One pair of the arms 116 extend away from the normal user's position at the table to engage the top edge of a working board, and another pair extend laterally with respect to the others to engage opposite sides of a working board or frame, and a pair of bottom arms 116 extend toward the normal user's position to engage and support the bottom edge of the working board. The mounting arms 116 are telescopically adjustable with respect to the mounting arm frame 114 so that they can be arranged to accommodate work surfaces of different sizes and configurations and have transversely projecting fingers 118 at their outer ends which engage the edges of the work board or frame and clamp it to the work engaging plate 92. A manually operable toggle lever 120 is mounted on each of the mounting arms 116, except the bottom arms, and interconnects with the mounting arm frame 114 (see FIG. 7). The toggle lever 120 is urged into a lock position by a spring 122, which urging can be overcome manually to permit sliding movement of the mounting arms 116 in the mounting arm frame 114, (see FIG. 11).

Figure 9:
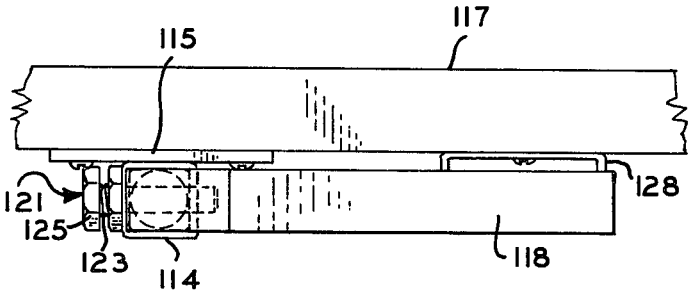
FIG. 9 is an enlarged sectional view taken at 9—9 in FIG. 1.

The bottom arms 116 are held in the mounting frame 114 by means of a plurality as longitudinally spaced holes 119 which are engaged by a lock pin 121 mounted in the lower ends of the frame 114. The lock pins 121 have shank portions which project into the holes 119 and thread shoulders 123 near their heads 125 which secure them in place (see FIGS. 3 and 9).

When an extension of the bottom arms of substantial length is unnecessary because the working surface to be mounted on the table top 117 is either closer to the same size, or smaller than the table top, then the fingers 118 on the bottom arms can either be placed next to the bottom edge of the table top 117 or stored beneath the table top. To provide means for holding the bottom arms 116 in stored position with the fingers 118 beneath the table top stow holes 124 are provided adjacent the fingers 118 at right angles to the holes 119. This permits the arms 116 to be rotated ninety degrees and secured by the lock pins 121 when they are stored. A magnetic holder 128 is provided on the underside of the table top 117 to secure the fingers 118 of the base clamps to the table top when they are not in use.

OPERATION

Having described the various parts of my invention and their relationship, I will now describe its operation. If a work surface 130 such as a work board is to be first assembled on the table top 117, this is done by using the mounting arms 116. The mounting arms 116 are extended away from the work engaging plate 92 and table top 117 a distance sufficient to more than accomodate the dimensions of the work surface or frame. The work surface 130 is then centered on the table top 117 and the bottom arms 116 are pinned in proper support position by adjusting the lock pins 121 in the holes 119. The frame 130 is then rested on the fingers 118 of the bottom arms 116 and the side and top mounting arms 116 are moved inwardly in the mounting arm frame 114 by actuating the toggle levers 120 until the fingers 118 at their distal portions engage the edges of the work surface (see FIG. 11). At this point the top and side arms 116 are secured by releasing their respective toggle levers 120 to lock the fingers 118 tight against the edges of the work surface, thereby clamping the work surface on the table top 117.

If a small working surface or frame is to be used, it can be positioned on the table top 117 by positioning the fingers 118 of the bottom arms 116 adjacent edge of the table top and resting the working surface on the fingers. Or, if the working surface is quite small, c-clamps or similar devices can be used to hold it on the table top and the fingers 118 of the lower mounting arms 116 rotated ninety degrees and stowed beneath the table top 117 by removing lock pin 121 from one of the position holes 119 and inserting it in a stow hole 124.

In lieu of an auxiliary working surface or frame the table top 117 may itself be used as a working surface.

To properly position the work surface with respect to the artist, height adjustment can be made by means of the turn screw 34. This is accomplished by rotating the handle 44 which in turn threads the turnscrew 34 on the lower shaft 32 and threads the upper shaft 36 into the blocknut 48 on the cross arm 26 in the support frame 16.

When the table top 117 has been placed at the desired height, it may be tilted to accommodate the user by releaseing the pawl 70 from the rachet gear 66 on the tilt shaft 52 and tilting the table top to the desired position. This is accomplished by manually pressing the actuating handle 84 against the adjacent support arm 24 as previously explained. When the desired position of tilt is achieved, the actuating handle 84 of the pawl lever 78 is released and the lock pawl 70 is driven by the compression spring into a lock position in the rachet gear 66.

Rotation of the table top to accommodate the user's desire is accomplished by releasing the plate clamp 104 in the base plate 94 by rotating the clamp shaft 106 by means of clamp handle 112. Work engaging plate 92 and table top 117 can then be turned with respect to base plate 94. When the desired rotational position of the table top is achieved, the plate clamp 104 is tightened again by means of the clamp shaft to secure the work engaging plate 92 against further rotation on the base plate 94.

From this description of a preferred embodiment of my artist's table, it will be understood that a great variety of work surface positions can be readily achieved by the user, and changes in position are easy to accomplish. Moreover, I have provided these features in a table which is of relatively lightweight construction and minimum bulk so that it is easy to move and inexpensive to manufacture. Furthermore, my table combines the features of both an artist's easel and a drafting table and accommodates work of a great variety of sizes and types.

It should thus be appreciated that my artist's table-easel is fully capable of achieving the objects and providing the advantages heretofore attributed to it.

I claim:

1. An artist's table-easel comprising:

a base disposed to rest upon a support surface;

a support frame mounted on said base and movable vertically with respect thereto;

height adjustment means disposed between said base and said support frame and manually operable to vertically move said support frame with respect to said base;

a tabletop mounting frame mounted in said support frame and including a tilt shaft and a pair of relatively rotatable concentrically disposed plates:

means movably mounting said tilt shaft in said support frame for movement about a generally horizontal axis;

lock means interposed between said tabletop frame and support frame and disposed to lock said tabletop frame in a particular rotational position about the axis of said tilt shaft;

work engaging means on one of said rotatable plates for engaging a work surface, said work engaging means including tabletop attachment means and clamp means for securing work on said tabletop;

said height adjustment means includes said support frame telescopically assembled with said base, and a turnbuckle having a threaded shaft being disposed between said base and said support frame and being manually operable by rotation of a turnscrew to elevate or lower said support frame with respect to said base by extension or retraction of said shafts;

said lock means includes a ratchet gear and pawl connectable to secure said tilt shaft in a particular rotational position about its axis, said pawl being manually disengageable from said rachet gear to permit rotation of said tile shaft to a different axial position;

said rotational positioning mechanism includes a pair of superimposed plates with a common rotational axis, said plates being rotational one with respect to the other about said axis, and lock means interconnected with said plates and disposed to releasably lock one plate with respect to the other, to selectively position said plates in a particular rotational relationship; and said tabletop clamping mechanism includes four extensible arms interconnected with one of said rotatable plates, said arms being telescopically extensible for accommodation of different sized and shaped work form, each of said arms having lock means for releasably securing said arm in a particular extended position.

2. An artist's table-easel comprising:

a base disposed to rest upon a support surface;

a support frame mounted on said base and movable vertically with respect thereto;

height adjustment means disposed between said base and said support frame and manually operable to vertically move said support frame with respect to said base;

a tabletop mounting frame mounted in said support frame and including a tilt shaft and a pair of relatively rotatable concentrically disposed plates;

means movably mounting said tilt shaft in said support frame for movement about a generally horizontal axis;

lock means interposed between said tabletop frame and support frame and disposed to lock said tabletop frame in a particular rotational position about the axis of said tilt shaft;

work engaging means on one of said rotatable plates for engaging a work surface, said work engaging means including tabletop attachment means and clamp means for securing work on said tabletop;

said rotational positioning mechanism includes a pair of superimposed plates with a common rotational axis, said plates being rotational one with respect to the other about said axis, and lock means interconnected with said plates and disposed to releasably lock one plate with respect to the other, to selectively position said plates in a particular rotational relationship; and said table top clamping mechanism includes four extensible arms interconnected with one of said rotatable plates, said arms being telescopically extensible for accommodation of different sized and shaped work form, each of said arms having lock means for releasably securing said arm in a particular extended position.

3. An artist's table-easel comprising:

a base disposed to rest upon a support surface;

a support frame mounted on said base and movable vertically with respect thereto;

height adjustment means disposed between said base and said support frame and manually operable for vertically moving said support frame with respect to said base;

a tabletop mounting frame mounted in said support frame including a tilt shaft, a pair of superimposed plates mounted on said tilt shaft, at least one of the plates being rotatable with respect to the other about a common axis of symmetry, and locking means interconnected with said pair of plates and disposed to releasably lock one plate with respect to the other for selectively positioning the plates in a particular rotational relationship;

means movably mounting said tilt shaft in said support frame for movement about a generally horizontal tilt axis;

locking means interposed between said tabletop mounting frame and support frame for releasably locking said tabletop frame in a particular rotational position about the tilt axis; and work engaging means mounted on said one plate of said pair of plates for engaging a work surface including a plurality of arms attached to said one plate and extending radially outwardly therefrom, said arms being telescopically extensible for accommodating different sized and shaped work forms, and releasable lock means for selectively securing said arms in a particular extended position.

* * * * *